United States Patent [19]

Graf et al.

[11] 4,448,338

[45] May 15, 1984

[54] PNEUMATIC NAIL DRIVER

[75] Inventors: Eugen Graf; Edwin Kindle, both of Triesen Liechtenstein, Fed. Rep. of Germany

[73] Assignee: Hilti Aktiengesellschaft

[21] Appl. No.: 328,741

[22] Filed: Dec. 8, 1981

[30] Foreign Application Priority Data

Dec. 17, 1980 [DE] Fed. Rep. of Germany ..... 3047638

[51] Int. Cl.[3] ..... B25C 1/04

[52] U.S. Cl. ..... 227/8; 91/5; 173/2; 173/13; 173/31; 173/112; 227/130

[58] Field of Search ..... 173/2, 6, 13, 31, 110, 173/112, 114, 116; 91/5; 227/8, 130; 81/429

[56] References Cited

U.S. PATENT DOCUMENTS 3,088,440 5/1963 Wilmer ..... 173/2
3,804,544 4/1974 Adams ..... 173/31
4,122,904 10/1978 Haytayan ..... 227/8
4,196,833 4/1980 Haytayan ..... 227/8
4,280,248 7/1981 Herubel ..... 17/1 B

*Primary Examiner*—Frank T. Yost
*Assistant Examiner*—Hien H. Phan
*Attorney, Agent, or Firm*—Toren, McGeady and Stanger

[57] ABSTRACT

In a pneumatic nail driver, compressed air drives a working piston in the driving direction within a working cylinder. An inlet valve controls the flow of compressed air into the working cylinder. A sensing element mounted on the front end of the driver moves opposite to the driving direction when it is pressed against the receiving material for the nail. The sensing element pivots a shift lever which in turn moves a safety valve for controlling in one position the flow of compressed air to the control space associated with the inlet valve and in another position to connect the control space to the ambient atmosphere.

1 Claim, 8 Drawing Figures

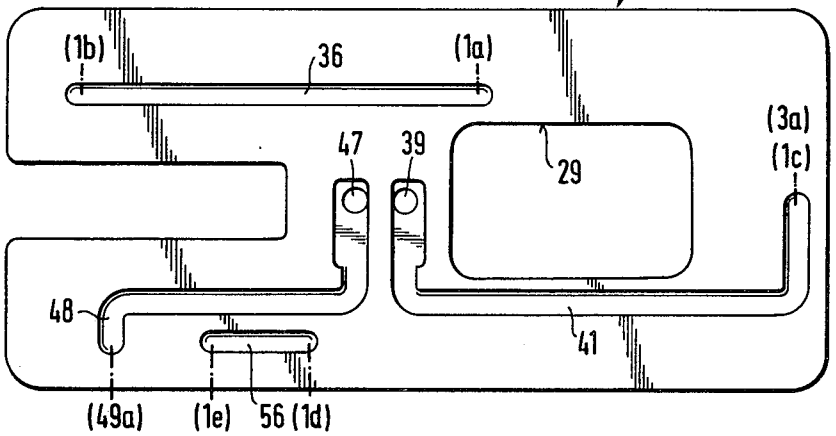
Fig. 1b
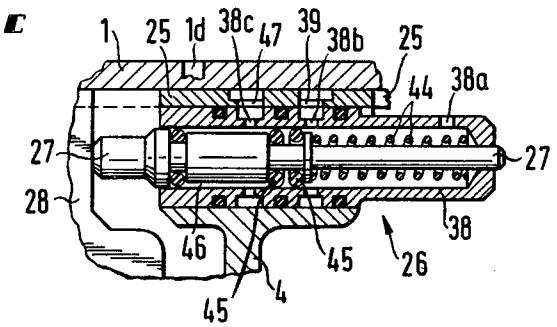
Fig. 1c
Fig. 1b

PNEUMATIC NAIL DRIVER

SUMMARY OF THE INVENTION

The present invention is directed to a pneumatic nail driver having a working piston which can be driven within a working cylinder in the forward or driving direction by compressed air. An inlet valve has an open position where it supplies compressed air to the working piston and a closed position where it blocks the flow of compressed air to the working piston. A safety valve is movable parallel to the axis of the working piston by activating a sensing element and moving it opposite to the driving direction against the force of a spring. The sensing element moves the safety valve from a position where it supplies the control space associated with the inlet valve with compressed air when the inlet valve is in the closed position to a position where the control space of the inlet valve is open to the ambient atmosphere when the inlet valve is in the open position.

In a known pneumatic nail driver, the flow of compressed air into the working chamber, required for the movement of the working piston, is controlled by an inlet valve which opens and closes the rearward end of the working cylinder. The inlet valve is operated pneumatically by a safety valve. To initiate the driving of a nail, the safety valve or its slide is moved by a sensing element, which projects in the inoperative position beyond the orifice of the device, and is displaced opposite to the driving direction of the working pistion when the pneumatic nail driver is pressed against a receiving material.

The accelerating force of the working piston developed when the device is subsequently triggered or fired, leads to a recoil, that is, the casing of the device and the parts of the device which are secured in place within the casing, experience a pulse-like acceleration opposite to the driving direction of the working piston. The slide of the safety valve is movably supported, parallel to the axis of the working piston, and the sensing element in locked engagement with the safety valve remains stationary relative to the receiving material due to their inertia so that during recoil the slide moves forwardly relative to the casing. Especially where there is a strong recoil action, such reaction often results in so-called double shots, that is, a second driving action after the completion of the driving-in step with the working piston again being driven forwardly in a second accelerating thrust. Such a second stroke leads to considerable complications, particularly in view of the anchoring quality, because the nail already driven in is exposed to a second and usually not precise driving action which tends to loosen the nailed connection. Further, the premature and uncoordinated second forward stroke of the working piston often leads to jamming of the nails within the driver as they move up from a magazine.

Therefore, the primary object of the present invention is to provide a pneumatic nail driver of the type described above in which such a second driving action is effectively prevented.

In accordance with the present invention, a shift lever is arranged to produce oppositely oriented movement between the safety valve and the sensing element.

The arrangement of the shift lever effects a 180° reversal movement of the sensing element relative to the movement of the safety valve which is in engagement with the shift lever. When the nail driving device is pressed in its muzzle region, before driving a nail, against the receiving material, the sensing element is displaced rearwardly. The shift lever, however, in response to such rearward movement displaces the safety valve in the forward direction. With the device pressed against the receiving material, the slide in the safety valve takes up a forward position which is defined as the end position by mechanical stop means.

If the device is then triggered, a driving action takes place and a recoil occurs. Due to the recoil, the casing and the parts secured to it are moved in the rearward direction, that is, the device lifts off the surface of the receiving material for a brief period against the pressure applied by the operator. The slide of the safety valve also undergoes this motion, because it is located in a front end position and is carried along by the casing parts. The force of inertia of the slide acts forwardly during recoil so that in this phase there is no change in the control setting of the safety valve. In this way it is particularly ensured that the control space of the inlet valve remains open during recoil with the open position maintained. Only after the device is subsequently lifted from the base material is the spring acting on the sensing element able to drive the sensing element in the forward direction so that the safety valve is reversed. The compressed air returns the working piston into the inoperative position, that is, in position for another driving cycle.

Advantageously, the shift lever is in locking engagement with the sensing element by way of engagement cams. Accordingly, actuation of the slide in the valve is guaranteed by the sensing element or the shift lever in the front control position, as well as in the rear control position, when the device is lifted off the receiving material. For this locking engagement, it is possible to provide the engagement cams on the shift lever whereby the sensing element engages between the engagement cams. For locking engagement, advantageously a trip cam is provided on the shift lever and the engagement cams are located on the sensing element. In particular, the two engagement cams can be provided in the form of shoulders on the sensing element. Preferably, the trip cam is in the form of a head arranged at one end of the shift lever on the side facing the sensing element. The head or trip cam extends between the engagement cams and thus is mechanically controlled alternately from the front or the rear.

It is also possible as an alternate to achieve the interaction of the shift lever and the slide of the safety valve by locking engagement of the trip cam and the engagement cams. The trip cam and the engagement cams may be located on the shift lever or the slide, as selected.

To prevent the change of the control setting of the safety valve due to inertia during recoil in a device in which the sensing element has a greater mass than the safety valve or its slide, in accordance with another feature of the invention, the spacing between the engagement cams is greater than the width of the trip cam located between the engagement cams so that a certain amount of free play is provided. Experience has shown that the device lifts during recoil, due to the force of reaction of the operator, only a part of the possible travel distance of the sensing element from the surface of the receiving material. This part of the travel distance and the related displacement of the shift lever is compensated by the above mentioned free play. Therefore, no reversing of the safety valve takes place.

The extent of the free play is such, when the device is lifted from the receiving material after a driving cycle has been completed, the sensing element biased by a spring advances in the driving direction for the full extent and in the final portion of its movement it reverses the slide or the safety valve by means of the shift lever, after it has compensated for the free play. It is only at this point that the working piston returns to the starting position under the action of compressed air admitted to its front side.

The dimension of the free play depends on the forward travel of the sensing element and the transmission ratios of the shift lever. Experience has shown that a dimension corresponding to a minimum of 10% and a maximum of 75% of the entire travel distance possible of the sensing element is suitable as the free play. An advantageous rule is to select the dimension between the engagement cams to be 2 to 3 times as large as the width of the trip cam which moves between the engagement cam.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 1*b* is a plan view of a circuit plate as used in the pneumatic nail driver;

FIG. 1*c* is an enlarged detail view of a trigger valve;

DETAIL DESCRIPTION OF THE INVENTION

Figures 1, 1A:
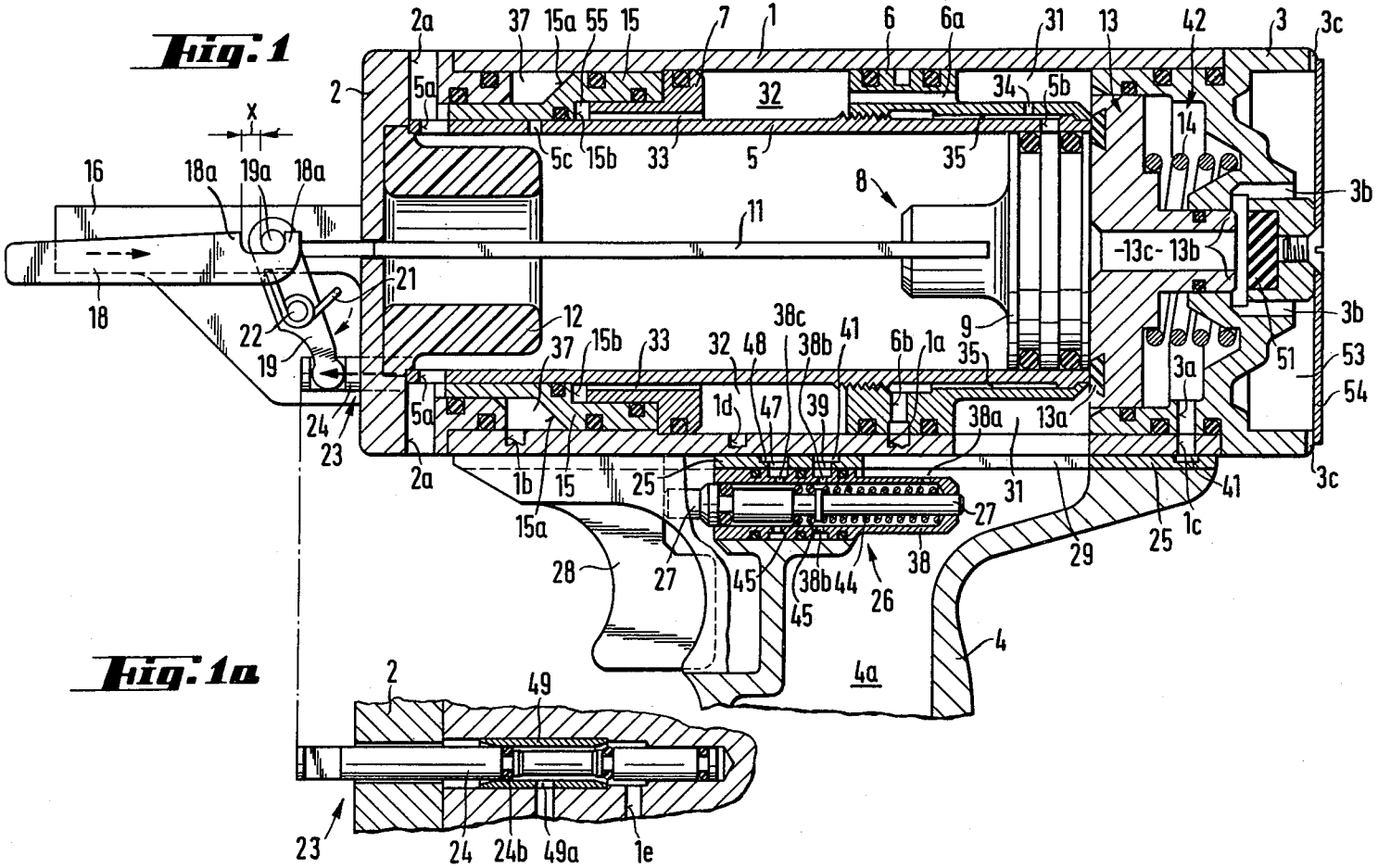
FIG. 1 is a side view, in section, through a pneumatic nail driver shown in position ready to drive a nail.
FIG. 1*a* is a detail view of a safety valve corresponding to the position shown in FIG. 1.
Figures 2, 2A:
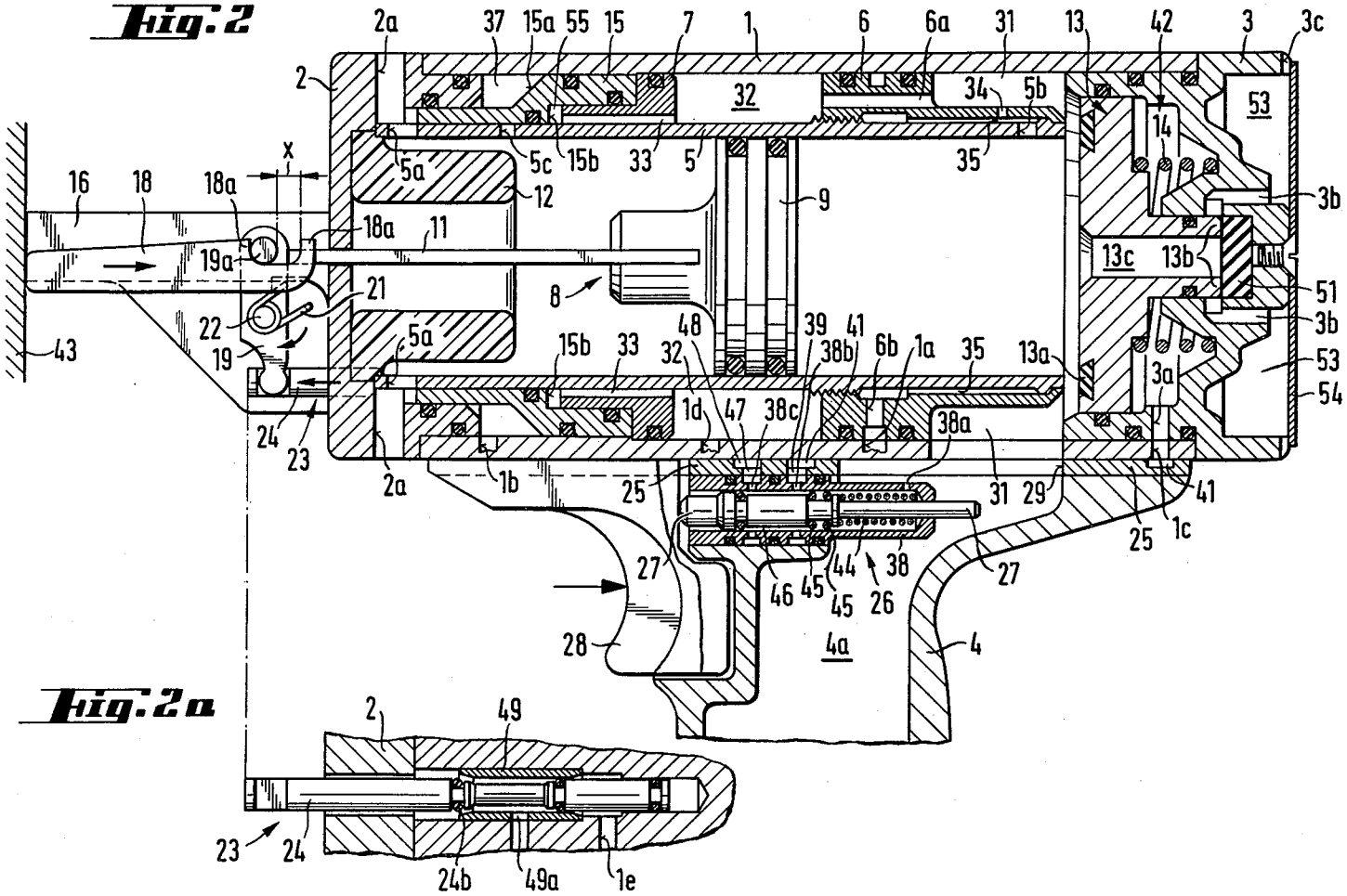
FIG. 2 is a view similar to that shown in FIG. 1, however, with the pneumatic nail driver performing the working or driving stroke.
FIG. 2*a* is a sectional view of the safety valve in the venting position corresponding to the position shown in FIG. 2.
Figures 3, 3A:
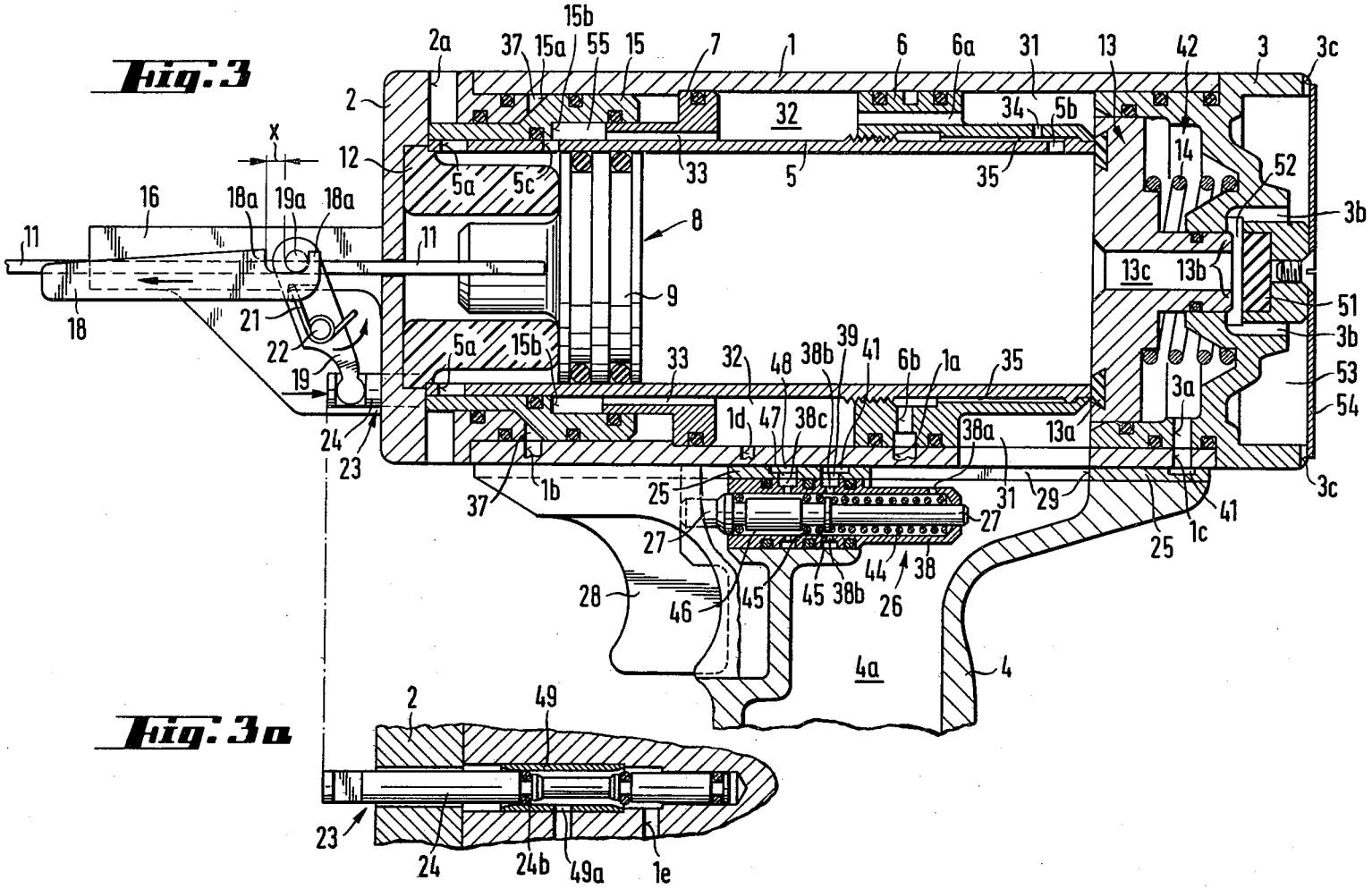
FIG. 3 is a view similar to FIG. 1 with the pneumatic nail driver shown in the position after the completion of the driving-in step and at the commencement of the recoil.
FIG. 3*a* is a view of the safety valve in the inoperative position, similar to FIG. 1*a*.

In FIGS. 1, 2 and 3 a pneumatic nail driver is illustrated including a hollow cylindrical casing 1 closed at its forward or left-hand end by a front cover and at its rearward end by a rear cover. A handle 4 is secured to and extends downwardly from the lower side of the casing 1.

Within and spaced inwardly from the casing 1 is a working cylinder 5 supported in a stationary position and guided in the radial direction by a rear annular member 6 and a front annular member 7. A working piston 8 is slidably mounted within the working cylinder and is made up of a head 9 in surface contact with the inner surface of the working cylinder and a ram 11 extending forwardly from the head and through the front cover 2. The forward stroke of the working piston 8 is limited by an elastic pad 12 projecting rearwardly from the front cover 2. As the head 9 approaches the front cover 2 it is stopped by the elastic pad 12. Basically, the rearward end of the working cylinder 5 is open and in the position shown in FIG. 1 with the driver ready to drive a nail, the rearward end is closed by a generally plate-shaped inlet valve 13. The position of the valve 13 is controlled by compressed air and a compression spring encircling the rear portion of the valve and extending between the valve and the rear cover 3. Forwardly of the rearward end of the working cylinder, the working cylinder 5 is surrounded by a revolving slide plate 15 which controls the return of the working piston 8 from its forward position into the rearward position illustrated in FIG. 1.

A muzzle projection 16 extends forwardly from the outside face of the front cover 2. The ram 11 penetrates through the muzzle projection during its working stroke to drive a nail, not shown, guided in the projection, into the receiving material. A rod-shaped sensing element 18 is movably supported on the muzzle projection 16 so that it can move relative to the projection toward and away from the front end of the casing 1. A shift lever 19 is mounted on the projection 16 and extends transversely of the sensing element 18. Shift lever 19 is pivotally mounted on a pivot pin 22. A spring 21 supported on the pivot pin 22 biases the sensing element 18 into the position illustrated in FIG. 1 where it projects forwardly from the front end of the muzzle projection 16. The displacement of the sensing element 18 moves the shift lever 19 by the contact of engagement cam 18*a* with a trip cam 19*a* located on the shift lever 19 and projecting into the recess in the sensing element between its engagement cams. Shift lever 19 controls a safety valve 23 which is not in the sectional plane shown in FIG. 1 and, therefore, is displayed separately in FIG. 1*a*. Safety valve 23 includes a rod-shaped slide 24 with a recess adjacent its forward end into which the lower end of the shift lever 19 extends. In other words, one end of the shift lever 19 carries the trip cam 19*a* while its other end, the lower end, seats within the recess in the slide 24. To do away with the use of movable control lines for the compressed air, a circuit plate 25 is clamped between the casing 1 and the handle 4 and it contains a number of grooves, note FIG. 1*b*. A trigger valve 26, shown enlarged in FIG. 1*c*, is positioned in the handle 4 and is in direct control connection with the circuit plate 25. A trigger 28 mounted in the handle actuates the slide 27 of the trigger valve.

In the position ready to drive a nail shown in FIG. 1, the following conditions prevail: The device is connected to an external compressed air source, not shown, which supplies the compressed air into the handle 4. Handle 4 has a hollow interior which serves as a storage space 4*a* for the compressed air. Compressed air flows through the opening 29 in the circuit plate 25 into a distribution space 31 encircling the rear portion of the rear annular member 6. Within the distribution space 31, the compressed air acts on an annular surface on the front face of the inlet valve 13 located radially outwardly from the working cylinder 5. In addition, the compressed air flows from the distribution space 31 through a bore 6*a* extending in the axial direction of the working cylinder 5 into an intermediate space 32 located between the rear and front annular members 6, 7. From intermediate space 32, the compressed air flows through a gap 33 between the front annular member and the outer surface of the working cylinder 5 and reaches a rear shoulder 15*b* on the revolving slide plate 15.

Further, compressed air flows from the distribution space 31 through a nozzle opening 34 into an annular gap 35 between the inner surface of the rear annular member 6 and the outer surface of the working cylinder 5 and then through a radially directed bore 6b in the rear annular member 6 into a bore 1a shown only partially because, in fact, it is spaced from the sectional plane of FIG. 1 and it opens into a groove 36 in the circuit plate 25, note FIG. 1b. The compressed air flows through the groove 36 to a bore 1b in the forward portion of the casing 1 for flow by way of the slide plate 15 into its control space 37. Since the front working surface 15a of the slide plate 15 is greater than the surface of the rear shoulder 15b also acted on by the compressed air, the slide plate 15 is held in the indicated position with the guide bores of the working cylinder 5 open to the ambient atmosphere through the bores 5a and 2a located at the forward end of the casing 1.

As long as the trigger 28 is not pressed inwardly, the compressed air is also connected from the storage space 4a by a control sleeve 38 of the trigger valve 26 as shown in detail in FIG. 1c. Control sleeve 38 has a rear opening 38a for the inflow of compressed air and another opening 38b located forwardly of opening 38a which provides for the outflow of compressed air. Opening 38b is connected to another opening 39 in the circuit plate 25 which opens into groove 41, note FIG. 1b. At the rearward end of groove 41 there is another opening 1c in the casing 1 aligned with an opening 3a in the rear cover 3. The air pressure present in the storage space 4a is also effective in the storage space 42 located on the rear side of the inlet valve 13 and in front of the rear cover 3. Due to the larger working surface of the inlet valve 13 within the storage space 42 and the compression spring 14, the inlet valve remains in the closed position against the rear end of the working cylinder 5. An annular seal 13a assures a good sealing action with the rear end edge of the working cylinder 5. To operate the nail driver, the muzzle projection 16 is pressed against the receiving material 43, note FIG. 2 after a nail has been charged into the projection. Sensing element 18 extending forwardly of the muzzle projection 16 contacts the receiving material 43 and is pushed rearwardly against the biasing force of the spring 21. The front engagement cam 18a moves rearwardly into contact with the trip cam 19a and pivots the shift lever 19 about the pivot pin 22. As a result of the pivoting action, the opposite or lower end of the shift lever displaces the slide 24 forwardly into the forward end position displayed in FIGS. 2 and 2a. Next, the trigger 28 is pressed inwardly and its slide 27 is moved rearwardly against the force of a trigger spring 44. The following is an explanation of the control situation in effect when the trigger is pressed and leads to the release of the driving action.

As compared to the pressure control arrangement described with regard to FIG. 1, when the trigger valve 26 is actuated, the compressed air supplied into the control space 42 via the control sleeve 38 is interrupted by sealing rings 45 on the slide 27. In this position of the trigger valve 26 with the forwardly displaced position of the slide 24, note FIGS. 2, 2a, the control space 42 is connected to the ambient atmosphere reducing the air pressure acting on the rear side of the slide 13. For this purpose the openings 3a and 1c, the groove 41, the connecting opening 39, the opening 38b, and annular space 46 formed between the slide 27 and the control sleeve 38 of the trigger valve 26, an additional opening 38c and a further connecting opening 47 and a further groove 48 in the circuit plate 25, an opening 49a located in a control sleeve 49 of the safety valve 23, as well as the axially extending opening around the slide 24 in the control sleeve 49 and the front cover 2 provide the opening to the atmosphere. Due to the reduction in the pressure within the control space 42, the compressed air still acting on the front annular surface of the inlet valve 13 is able to displace this valve rearwardly against the action of the compression spring 14, moving it into the open position.

With the inlet valve 13 in the open position, compressed air flows from the storage space 4a through the distribution space 31 across the rear end face of the head 9 which is still located at the rear end of the working cylinder 5. With the pressure build-up at the rear end face, the working piston is accelerated forwardly through the interior of the working cylinder 5 with the air located forwardly of the head 9 escaping to the ambient atmosphere through the bores 5a and 2a. During the working stroke of the piston 8, any outflow of the compressed air driving the piston forward must be prevented. Accordingly, a neck-shaped projection 13b is provided on the rearward side of the inlet valve 13 and bears against a sealing stop 51 supported on the rear cover 3. A central bore 13c extending through the inlet valve and its projection 13b is closed by the stop 51. Note in FIG. 1 that the rearward end of the projection 13b is spaced from the stop 51.

When the compressed air has driven working piston 8 forwardly so that its head 9 contacts the elastic pad 12, and the ram 11 has driven a nail into the receiving material 43, the device is lifted from the receiving material. When the sensing element 18 is no longer displaced rearwardly, it returns to the initial position, shown in FIG. 1, driven by the spring 21 pivoting the shift lever 19 and moving the slide rearwardly or inwardly into the casing 1. A front sealing ring 24b closes the axially extending bore of the control sleeve 49, closing it off relative to the ambient atmosphere and also closing off the control space 42 between inlet valve 13 and the rear cover 3. This position of the safety valve 23 is shown in FIG. 3a.

When the trigger 28 is released, it is driven forwardly by the spring 44 and returns to the starting position, illustrated in FIG. 3, by the side 27 of the trigger valve 26. Slide 27 resumes the control position shown and described in FIGS. 1 and 1c. Consequently, compressed air from the storage space 4a again flows through the control sleeve 38, the groove 41, and openings 1c and 3a into the control space 42. With the aid of the compressed spring 14, the inlet valve is returned into the closed position shown in FIGS. 1 and 3.

In FIG. 3, however, the working piston 8 is still in the forward position within the working cylinder 5. Compressed air in the working cylinder 5 behind the head 9 can escape outside of the device via the central bore 13c in the inlet valve 13 and the gap 52 located between the rearward end of projection 13b and the stop 51 and then passing through the openings 3b extending the axial direction of the working cylinder through the cover portion 3 into a hollow annular chamber 53 formed within the rear cover 3 and the disc 54 which extends across the rear end of the rear cover and finally passing out through the grooves 3c. Since an opening 5b located near the rearward end of the working cylinder 5, which previously had been closed by the head 9, is now in connection with the annular gap 35, the compressed air can exit from the control space 37.

Compressed air still acts on the rear shoulder 15*b* and moves the revolving slide plate 15 forwardly closing the openings 5*a* and connecting the openings 5*c* in the working cylinder 5 with the control space 55 located behind the shoulder 15*b*. Therefore, compressed air flows from control space 55 through the opening 5*c* into the space within the working cylinder 5 forwardly of the piston head 9 so that the working piston 8 is driven in the rearward direction. When the working piston 8 reaches the rearward position shown in FIG. 1, its head 9 again closes the opening 5*b*. As a result, there is a pressure increase in the control space 37 explained in relation to FIG. 1, and the revolving slide plate 15 is moved rearwardly. The nail driver again resumes the position shown in FIG. 1.

To guarantee operation of the nail driving device even if the trigger 28 is activated instead of the sensing element 18, the following control loop is provided:

If the trigger 28 is activated first, then the supply of compressed air from the storage space 4*a* via the control sleeve 38 into the control space 42 is interrupted by the sealing rings 45, note FIG. 2. Air pressure in control space 42 is maintained by the safety valve 23 with compressed air from the intermediate space 32 communicating with the control space 42 by way of an additional opening 1*d* located behind the sectional plane of FIG. 2, a groove 56 in the circuit plate 25 and an opening 1*e*, the axial bore in the safety valve 23, the opening 49*a*, the groove 48, the connecting opening 47, note FIG. 1*b*, the opening 38*c*, the annular space 46, the opening 38*b*, the connecting opening 39, the groove 41 and the openings 1*c* and 3*a*.

Subsequently, when the sensing element is pushed rearwardly, slide 24 moves into the forward position shown in FIGS. 2 and 2*a* with the release of pressure being effected from control space 42.

Consequently, to drive a nail, sensing element 18 and trigger 28 must be actuated as is evident in FIG. 2. When the shift lever 19 is pivotally displaced by the sensing element 18, the slide 24 is pulled out into the forward operating position, note FIG. 2*a*. Between the trip cam 19*a* on the shift lever and the engagement cams 18*a* in the sensing element 18, there is an amount of free play x corresponding approximately to the width or diameter of the trip cam. The function of this free play is now explained.

When the working piston executes a complete forward stroke the nail driver experiences a recoil, that is, the casing 1 and the parts connected with it rebound. Slide 24, because it is in its most forward position, is accelerated in a pulse-like manner by the recoil action moving opposite to the driving direction. This does not, however, result in a relative displacement of the slide 24 or a change in the switching function of the safety valve 23. The sensing element moves forwardly during the brief lifting of the other parts of the nail driver from the base material 43 due to the recoil. The extent to which the nail driver is lifted from the base material 43 represents only a part of the possible movement of the sensing element 18 relative to the muzzle projection 16, because of the pressure exerted by the operator which counteracts the lifting tendency. Therefore, the sensing element 18 moves forwardly for only a portion of the possible distance it can move relative to the muzzle projection. This partial forward travel of the sensing element 18 is compensated for by the free play x, that is, the shift lever is not pivoted during such travel and the slide 24 is not reversed. After the recoil or rebound takes place the nail driver is pressed within fractions of a second against the base material and the safety free play x is reestablished and continues until the driving-in step is completed. After the completion of the driving-in step, the device is then lifted from the base material 43 ready to be moved to another area for driving in another nail. When the nail driver is completely removed from the base material 43, the sensing element 18 moves forwardly for the full displacement distance relative to the muzzle projection 16 and this displacement pivots the shift lever and displaces the slide rearwardly into the inoperative position of FIG. 1*a*. When the slide moves rearwardly the return stroke of the working piston takes place in the manner described above.

The various guard rings shown in the drawing but having no special function relative to the invention, have not been discussed for reasons of simplicity.

While specific embodiments of the invention have been shown and described in detail to illustrate the application of the inventive principles, it will be understood that the invention may be embodied otherwise without departing from such principles.

We claim:

1. A pneumatic nail driver comprising an axially extending working cylinder having a front end and a rear end and arranged to receive a supply of compressed air, a working piston positioned within said working cylinder and arranged to be driven in the axial direction thereof from the rear end toward the front end of said working cylinder by compressed air supplied into said working cylinder, an inlet valve having an open position for supplying compressed air into driving contact with said working piston and a closed position for blocking the flow of compressed air into driving contact with said working piston, said inlet valve in combination with said working cylinder forming a control space, a safety valve mounted on said working cylinder and movable parallel to the axis of said working cylinder, means in operative engagement with said safety valve for moving said safety valve, said means including a sensing element movably mounted for movement opposite to the driving direction for moving said safety valve when said sensing element is pressed against a receiving material into which a nail is to driven, and a spring arranged to bias said sensing element in the driving direction, said safety valve is movable between a first position in which it supplies said control space with compressed air in the closed position of said inlet valve and a second position where it connects said control space in the open position of said inlet valve with the ambient atmosphere, wherein the improvement comprises that said means includes a shift lever having a first end in engagement with said sensing element and a second end in engagement with said safety valve for moving said safety valve in a direction opposite to the movement of said sensing element, engagement cams spaced apart in the driving direction and associated with said sensing element, said shift lever displaceable into locking engagement with said engagement cams, said engagement cams are formed on said sensing element, a trip cam formed on said shift lever, said trip cam is movable between and into locking engagement with said engagement cams, the spacing between said engagement cams is greater than the width of said trip cam in the driving direction so that when said trip cam is in engagement with one of said engagement cams an amount of free play is provided between said trip cam and the other one of said engagement cams.

* * * * *